US009429326B2

(12) United States Patent
Kato et al.

(10) Patent No.: US 9,429,326 B2
(45) Date of Patent: Aug. 30, 2016

(54) COMBUSTOR NOZZLE ASSEMBLY, COMBUSTOR EQUIPPED WITH THE SAME, AND GAS TURBINE

(71) Applicant: MITSUBISHI HEAVY INDUSTRIES, LTD., Tokyo (JP)

(72) Inventors: Shin Kato, Tokyo (JP); Yoshitaka Terada, Yokohama (JP); Takashi Onozuka, Yokohama (JP); Eiji Takami, Minato-ku (JP); Kenji Miyamoto, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 593 days.

(21) Appl. No.: 13/796,345

(22) Filed: Mar. 12, 2013

(65) Prior Publication Data

US 2014/0026578 A1 Jan. 30, 2014

(30) Foreign Application Priority Data

Jul. 30, 2012 (JP) ..... 2012-168535

(51) Int. Cl.
*F23R 3/36* (2006.01)
*F23R 3/28* (2006.01)

(52) U.S. Cl.
CPC *F23R 3/36* (2013.01); *F23R 3/283* (2013.01)

(58) Field of Classification Search
CPC ..... F23R 3/36; F23R 3/28; F23R 3/283; F23R 2900/00012; F23C 5/02; F02C 7/20; F02C 7/22; F02C 7/222; F02M 61/14
See application file for complete search history.

(56) References Cited

U.S. PATENT DOCUMENTS 4,409,791 A * 10/1983 Jourdain et al. ..... 60/240
6,755,024 B1 * 6/2004 Mao et al. ..... 60/776
6,761,035 B1 * 7/2004 Mueller ..... 60/800
7,290,394 B2 * 11/2007 Lehtinen ..... 60/800
7,827,795 B2 * 11/2010 Hicks et al. ..... 60/728

(Continued)

FOREIGN PATENT DOCUMENTS

CN 101354141 A 1/2009
CN 101784841 A 7/2010

(Continued)

OTHER PUBLICATIONS

International Search Report of PCT/JP2013/056870, date of mailing May 14, 2013.

(Continued)

*Primary Examiner* — Carlos A Rivera
(74) *Attorney, Agent, or Firm* — Westerman, Hattori, Daniels & Adrian, LLP

(57) ABSTRACT

A combustor nozzle assembly includes: a nozzle mounting base which blocks a combustor insertion opening formed in a turbine casing; a nozzle rod which passes through the nozzle mounting base and has a rod tip portion and a rod base end portion; an oil fuel pipe which is as a whole inserted into the nozzle rod, which has a pipe tip portion and a pipe base end portion, in which fuel is supplied to the inside through the rod base end portion, and which injects the fuel from the pipe tip portion through the rod tip portion; and an O-ring which is disposed in the rod base end portion and suppresses leakage of fuel to the pipe tip portion side between the inner periphery side of the nozzle rod and the outer periphery side of the oil fuel pipe.

6 Claims, 7 Drawing Sheets

(56) References Cited

U.S. PATENT DOCUMENTS

| | | | | |
|---|---|---|---|---|
| 7,832,377 | B2 * | 11/2010 | Lee et al. | 123/470 |
| 2004/0129001 | A1 * | 7/2004 | Lehtinen | 60/740 |
| 2007/0137218 | A1 * | 6/2007 | Prociw et al. | 60/796 |
| 2007/0151255 | A1 * | 7/2007 | Johnson et al. | 60/776 |
| 2009/0223225 | A1 * | 9/2009 | Kraemer et al. | 60/723 |
| 2009/0277176 | A1 * | 11/2009 | Caples | 60/737 |
| 2011/0089267 | A1 * | 4/2011 | Stoia et al. | 239/589 |

FOREIGN PATENT DOCUMENTS

| | | | |
|---|---|---|---|
| CN | 102297429 | A | 12/2011 |
| JP | 6-34135 | A | 2/1994 |
| JP | 10-26352 | A | 1/1998 |
| JP | 2003-106528 | A | 4/2003 |
| JP | 3861035 | B2 | 12/2006 |
| JP | 2008-190402 | A | 8/2008 |
| JP | 2009-52513 | A | 3/2009 |
| JP | 2009-52859 | A | 3/2009 |
| JP | 2011-085385 | A | 4/2011 |

OTHER PUBLICATIONS

Written Opinion of PCT/JP2013/056870, date of mailing May 14, 2013.

Office Action dated Aug. 3, 2015, issued in counterpart Chinese Application No. 201380039058.0, with English translation. (10 pages).

A Notice of Allowance dated Apr. 5, 2016, issued in counterpart Japanese Patent Application No. 2012-168535, with English translation. (6 pages).

* cited by examiner

COMBUSTOR NOZZLE ASSEMBLY, COMBUSTOR EQUIPPED WITH THE SAME, AND GAS TURBINE

TECHNICAL FIELD

The present invention relates to a combustor nozzle assembly that injects fuel, a combustor equipped with the combustor nozzle assembly, and a gas turbine. Priority is claimed on Japanese Patent Application No. 2012-168535 filed on Jul. 30, 2012, the contents of which are incorporated herein by reference.

BACKGROUND ART

A combustor of a gas turbine includes a nozzle assembly having a nozzle which injects fuel into compressed air from a compressor of the gas turbine, and a transition piece which leads high-temperature gas generated by mixing fuel injected from a nozzle with the compressed air and burning the mixture, to a turbine. Although the present invention is not limited to this, as the nozzle, there is a so-called dual nozzle which injects both fuel oil and fuel gas.

The dual nozzle has a double-pipe structure, as shown in FIG. 5 of, for example, Patent Document 1 below, and includes a tubular nozzle rod and a tubular oil fuel pipe which is disposed in the nozzle rod. In the nozzle rod, a gaseous fuel flow path, through which gaseous fuel passes, is formed in a portion further on the outer periphery side than a pipe insertion space in which the oil fuel pipe is inserted. Further, the nozzle rod is fixed to a nozzle mounting base which blocks a combustor insertion opening formed in a gas turbine casing. A pipe tip portion of the oil fuel pipe is fixed to a rod tip portion of the nozzle rod. A pipe base end portion of the oil fuel pipe protrudes from a rod base end portion of the nozzle rod and the nozzle mounting base and is inserted in an oil manifold fixed to the nozzle mounting base. Oil fuel is supplied into the oil manifold and flows in the oil fuel pipe from there.

When the oil fuel is injected from the dual nozzle and burned (an oil firing operation), the oil fuel pipe is cooled by the oil fuel which flows therein. On the other hand, since the nozzle rod is exposed to the flow of the compressed air from the compressor of the gas turbine, the nozzle rod is heated by the compressed air. For this reason, although the temperatures of the oil fuel pipe and the nozzle rod are uniform at the time of stopping of the gas turbine, during the oil firing operation of the gas turbine, the temperature of the nozzle rod becomes relatively high with respect to the temperature of the oil fuel pipe. Due to this difference in temperature, a difference in thermal expansion between the oil fuel pipe and the nozzle rod occurs.

Further, when gaseous fuel is injected from the dual nozzle and burned (a gas firing operation), the oil fuel pipe is not cooled by the oil fuel. For this reason, the oil fuel pipe has a temperature close to the temperature of the nozzle rod and becomes hotter than when the oil fuel is burned. However, the temperature of the oil fuel pipe does not rise as much as the temperature of the nozzle rod directly exposed to the flow of the compressed air. Accordingly, even during the gas firing operation of the gas turbine, a difference in temperatures between the oil fuel pipe and the nozzle rod occurs, and as a result, a difference in thermal expansion between the oil fuel pipe and the nozzle rod occurs.

In this manner, since a difference in thermal expansion between the oil fuel pipe and the nozzle rod occurs, although the pipe tip portion of the oil fuel pipe is fixed to the rod tip portion of the nozzle rod, the pipe base end portion of the oil fuel pipe is inserted in the oil manifold so as to be able to relatively move with respect to the oil manifold. An O-ring is disposed between the outer periphery of the pipe base end portion of the oil fuel pipe and the inner surface of the oil manifold in order to suppress leakage of the oil fuel from between them while allowing a difference in expansion of the oil fuel pipe.

Incidentally, in the dual nozzle described above, heat in the gas turbine casing is easily transmitted to the O-ring or a rod base end portion of an oil fuel rod through the nozzle mounting base and the oil manifold. For this reason, the O-ring sometimes gets damaged due to heat being applied in a short period of time.

Therefore, in Patent Document 1, as shown in FIGS. 2 and 3 of Patent Document 1, there is proposed a technique to insert the pipe base end portion of the oil fuel pipe into the oil manifold by separating the oil manifold from the nozzle mounting base and making the amount of protrusion of the oil fuel pipe from the nozzle mounting base large. In addition, in Patent Document 1, there is also proposed a technique to provide a leaked oil recovery chamber on the pipe tip portion side of the oil fuel pipe based on the O-ring in the oil manifold in order to prevent leakage of the oil fuel due to the damage to the O-ring.

PRIOR ART DOCUMENT

Patent Document

Patent Document 1: Japanese Unexamined Patent Application, First Publication No. 2008-190402

SUMMARY OF INVENTION

Problem to be Solved by the Invention

In the technique disclosed in Patent Document 1 above, since the amount of heat transferred to the O-ring is surely reduced, the O-ring can be prevented from being damaged in a short period of time. In addition, even if the O-ring is damaged, since the leaked oil recovery chamber is present, the oil fuel leaking outside can be prevented. However, in the technique disclosed in Patent Document 1 above, the leaked oil recovery chamber is provided, whereby a structure of the oil manifold becomes complicated, and in addition, a support which supports the oil manifold is separately required, and thus there is a problem in that the manufacturing cost increases.

The present invention has an object to provide a combustor nozzle assembly in which fuel leaking outside can be prevented even while reducing the manufacturing cost, a combustor equipped with the combustor nozzle assembly, and a gas turbine.

Means for Solving the Problems

According to a first aspect of the present invention, a combustor nozzle assembly includes: a nozzle mounting base which blocks a combustor insertion opening formed in a turbine casing; a nozzle rod which is formed in a tubular shape, passes through the nozzle mounting base, and has a rod tip portion protruding to the inside of the turbine casing and a rod base end portion protruding to the outside of the turbine casing; a fuel pipe which is formed in a tubular shape, which is as a whole inserted into the nozzle rod, which has a pipe tip portion fixed to the rod tip portion of the nozzle rod and a pipe base end portion inserted into the rod base end portion of the nozzle rod, in which fuel is supplied to the inside through the rod base end portion, and which injects the fuel from the pipe tip portion through the rod tip portion of the nozzle rod; and a seal member which is disposed in the rod base end portion of the nozzle rod and suppresses leakage of the fuel to the pipe tip portion side between the inner periphery side of the nozzle rod and the outer periphery side of the fuel pipe.

In the combustor nozzle assembly, since the seal member is disposed in the rod base end portion of the nozzle rod which protrudes to the outside of the turbine casing, heating of the seal member by heat from the nozzle mounting base or the like can be suppressed. Accordingly, in the combustor nozzle assembly, damage to the seal member due to heat can be suppressed.

In addition, in the combustor nozzle assembly, since the entire fuel pipe is inserted in the nozzle rod, even if the seal member which suppresses leakage of fuel to the pipe tip portion side between the inner periphery side of the nozzle rod and the outer periphery side of the fuel pipe is damaged, leakage of the fuel can be prevented because the fuel flows in between the inner peripheral surface of the nozzle rod and the outer peripheral surface of the fuel pipe. Accordingly, in the combustor nozzle assembly, since an oil manifold having a complicated shape, in which a leaked oil recovery chamber is formed, and a support thereof become unnecessary, the manufacturing cost can be reduced.

In the combustor nozzle assembly, the nozzle rod may have a mounting portion which is located in the nozzle mounting base, and a cross-sectional area reduced portion which is a portion between the mounting portion and the rod base end portion and in which a cross-sectional area in a cross section perpendicular to a direction in which the nozzle rod extends is smaller than the maximum cross-sectional area of the mounting portion.

Since the cross-sectional area reduced portion is interposed between the rod base end portion of the nozzle rod in the combustor nozzle assembly and the mounting portion which is located in the nozzle mounting base, the rod base end portion of the nozzle rod exists at a position relatively far from the nozzle mounting base. For this reason, heat that the rod base end portion of the nozzle rod receives from the nozzle mounting base can be reduced. Further, since the cross-sectional area of the cross-sectional area reduced portion of the nozzle rod is smaller than the maximum cross-sectional area of the mounting portion of the nozzle rod, thermal resistance in a heat transfer pathway from the nozzle mounting base or the like to the rod base end portion increases.

For this reason, in the combustor nozzle, damage to the seal member in the rod base end portion due to heat can be suppressed.

In the combustor nozzle assembly in which the nozzle rod has the cross-sectional area reduced portion, it is preferable that the cross-sectional area reduced portion of the nozzle rod be exposed to the outside of a combustor.

In the combustor nozzle assembly, since the cross-sectional area reduced portion between the mounting portion and the rod base end portion of the nozzle rod is exposed to the outside of the combustor, heat transmitted from the mounting portion to the cross-sectional area reduced portion can be released to the outside of the combustor. Accordingly, in the combustor nozzle assembly, heat which is transmitted from the cross-sectional area reduced portion to the rod base end portion can be reduced, and thus damage to the seal member due to a higher temperature can be suppressed.

Further, in either one of the combustor nozzle assemblies described above, the rod base end portion of the nozzle rod may be exposed to the outside of a combustor.

In the combustor nozzle assembly, heat transmitted to the rod base end portion can be released to the outside of the combustor. Accordingly, in the combustor nozzle assembly, heat which is transmitted from the rod base end portion to the seal member can be reduced, and thus damage to the seal member due to a higher temperature can be suppressed.

Further, either one of the combustor nozzle assemblies described above may further include a fuel receiving pipe which is connected to the rod base end portion of the nozzle rod and supplies the fuel into the fuel pipe through the rod base end portion.

In a case of supplying fuel into the fuel pipe through the rod base end portion of the nozzle rod, a method to cover the rod base end portion with a manifold for fuel supply and a method to provide a fuel receiving pipe, as in the combustor nozzle assembly described above, are conceivable. In the former method, since the rod base end portion is covered with the manifold for fuel supply, release of heat from the rod base end portion to the outside cannot be expected too much. On the other hand, in the latter method, since the rod base end portion is not covered with the manifold for fuel supply, release of heat from the rod base end portion to the outside can be expected.

Accordingly, in the combustor nozzle assembly, heat which is transmitted from the rod base end portion to the seal member can be reduced, and thus damage to the seal member due to a higher temperature can be suppressed.

According to a second aspect of the present invention, a combustor includes: either one of the combustor nozzle assemblies described above; and a transition piece which leads combustion gas generated by burning of fuel injected from the nozzle of the combustor nozzle assembly, to a turbine.

According to a third aspect of the present invention, a gas turbine includes: the combustor; a turbine rotor which is rotated by the combustion gas from the combustor; and the turbine casing which covers the turbine rotor and on which the combustor is mounted.

Effects of the Invention

In the present invention, even if an oil manifold having a complicated shape, in which a leaked oil recovery chamber is formed, is not provided, it is possible to prevent leakage of fuel. Further, since it is not necessary to provide a support, the manufacturing cost can be reduced.

DESCRIPTION OF THE EMBODIMENTS

Figure 1:
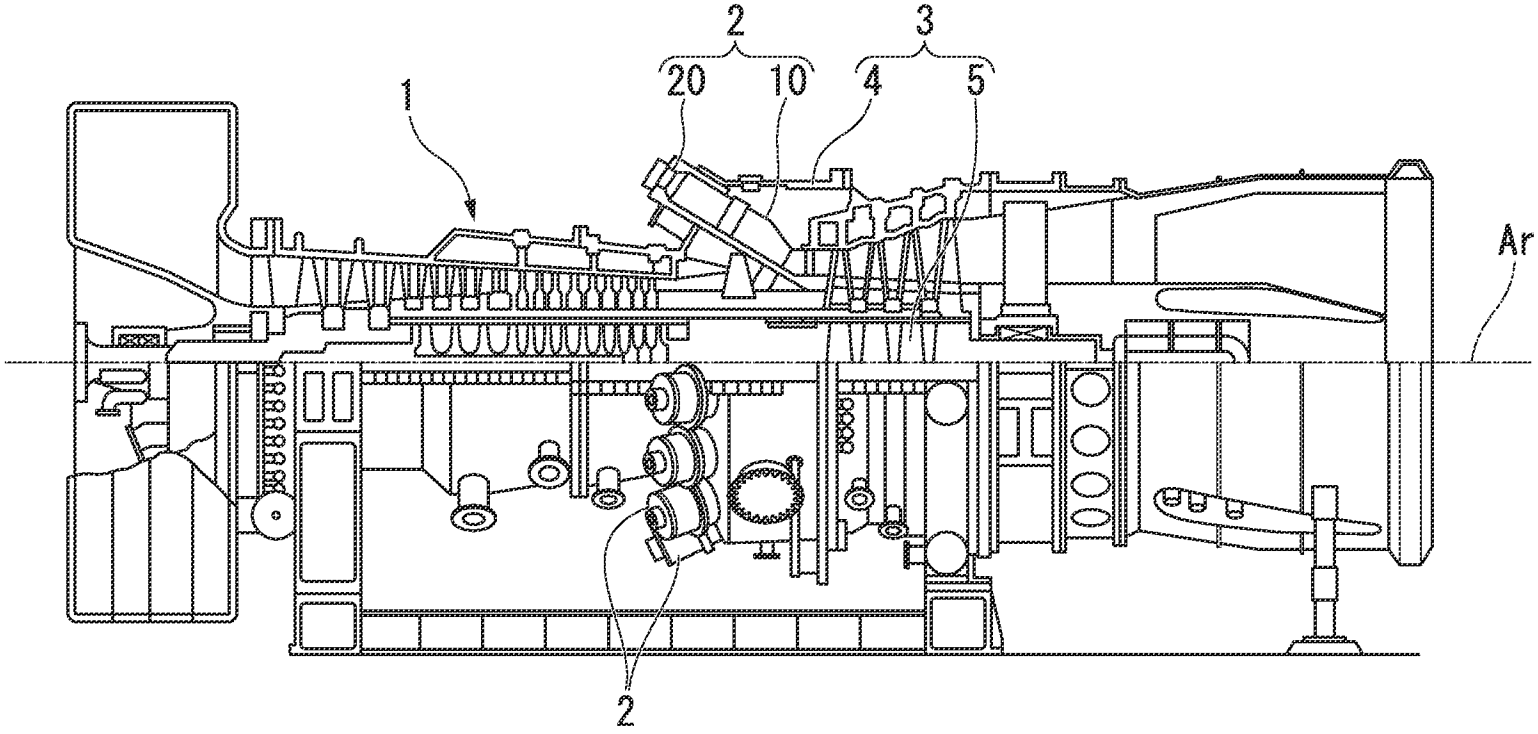
FIG. 1 is an overall side view, with a main section partially cut away, of a gas turbine according to an embodiment of the present invention.

Hereinafter, an embodiment of a combustor nozzle assembly, a combustor equipped with the combustor nozzle assembly, and a gas turbine according to an embodiment of the present invention will be described in detail referring to the drawings.

The gas turbine according to this embodiment includes a compressor 1 which compresses external air, thereby generating compressed air, a plurality of combustors 2 which mixes fuel from a fuel supply source with the compressed air and burns the mixture, thereby generating combustion gas, and a turbine 3 which is driven by the combustion gas, as shown in FIG. 1.

The turbine 3 includes a turbine casing 4 and a turbine rotor 5 which rotates in the turbine casing 4. The turbine rotor 5 is connected to, for example, an electric generator (not shown) which generates electricity by rotation of the turbine rotor 5. The plurality of combustors 2 are fixed to the turbine casing 4 at equal intervals with respect to each other in a circumferential direction with an axis of rotation Ar of the turbine rotor 5 as the center. The combustor 2 includes a transition piece 10 which sends high-temperature and high-pressure combustion gas to blades of the turbine rotor 5, and a combustor nozzle assembly 20 which supplies the fuel and the compressed air into the transition piece 10. In addition, in the following, the combustor nozzle assembly 20 is simply referred to as a nozzle assembly 20.

Figure 2:
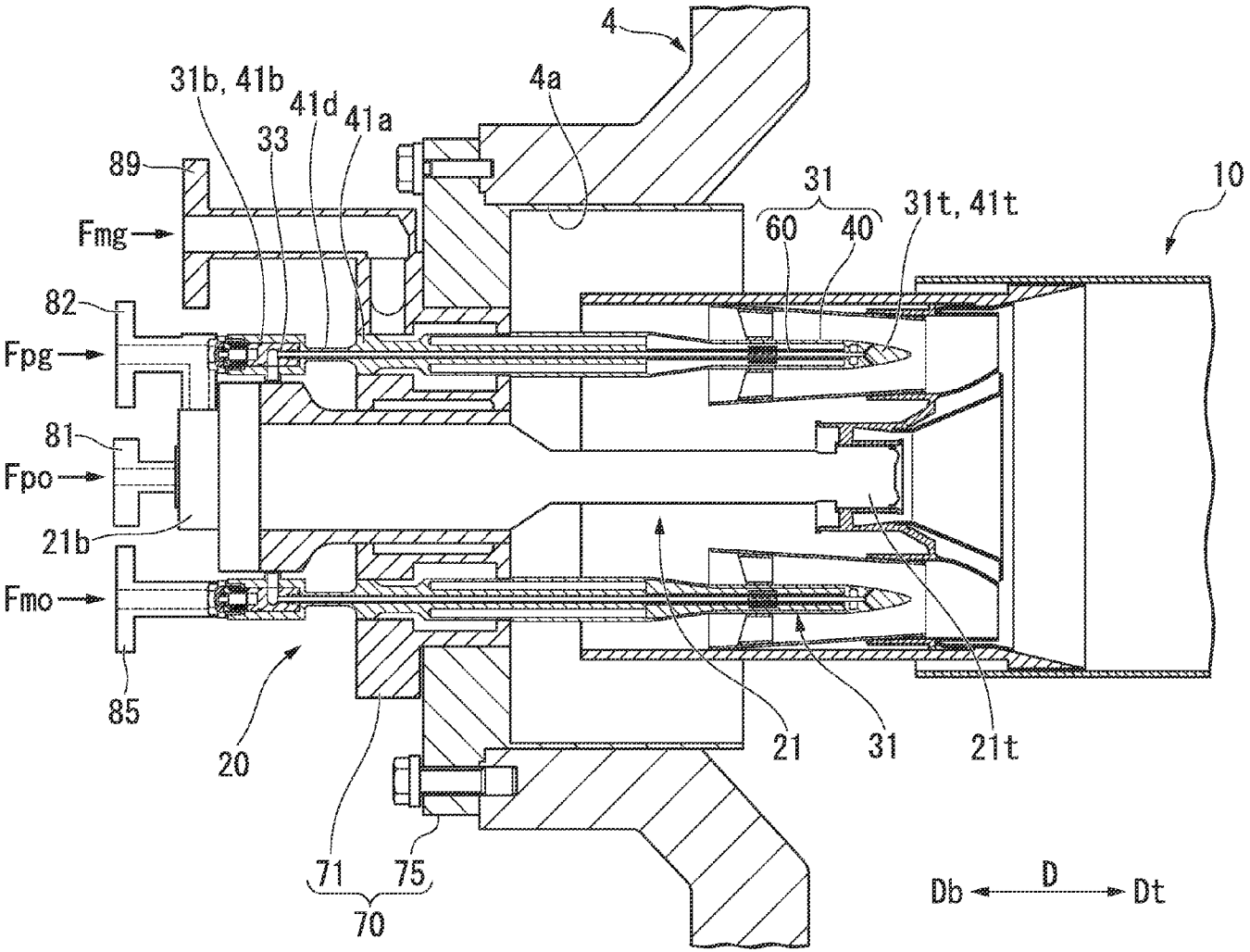
FIG. 2 is a cross-sectional view of a surrounding of a combustor of the gas turbine according to an embodiment of the present invention.

The nozzle assembly 20 includes a pilot nozzle 21, a plurality of main nozzles 31 which are disposed at equal intervals in the circumferential direction with the pilot nozzle 21 as the center, a nozzle mounting base 70 on which the pilot nozzle 21 and the plurality of main nozzles 31 are mounted, as shown in FIG. 2.

A combustor insertion opening 4*a* is formed in the turbine casing 4. The nozzle mounting base 70 blocks the combustor insertion opening 4*a*. The nozzle mounting base 70 has a nozzle stand 71 on which the pilot nozzle 21 and the plurality of main nozzles 31 are mounted, and a nozzle stand frame 75 to which the nozzle stand 71 is fixed. The nozzle stand frame 75 is fixed to the turbine casing 4 by bolts.

Both the pilot nozzle 21 and the main nozzle 31 are formed in a rod shape and directed in the same direction. Both the pilot nozzle 21 and the main nozzle 31 pass through the nozzle mounting base 70. A tip portion 21*t* of the pilot nozzle 21 and a tip portion 31*t* of the main nozzle 31 protrude into the turbine casing 4. Further, a base end portion 21*b* of the pilot nozzle 21 and a base end portion 31*b* of the main nozzle 31 protrude to the outside of the turbine casing 4. In addition, in the following, a direction in which the pilot nozzle 21 and the main nozzle 31 extend is set to be a nozzle longitudinal direction D, a direction in which the tip portions 21*t* and 31*t* of the pilot nozzle 21 and the main nozzle 31 are directed, in the nozzle longitudinal direction D, is set to be a tip side Dt, and a direction in which the base end portions 21*b* and 31*b* of the pilot nozzle 21 and the main nozzle 31 are directed, in the nozzle longitudinal direction D, is set to be a base end side Db.

A P-oil fuel receiving pipe 81 which receives oil fuel Fpo and a P-gaseous fuel receiving pipe 82 which receives gaseous fuel Fpg are connected to the base end portion 21*b* of the pilot nozzle 21. An oil fuel flow path (not shown) through which the oil fuel Fpo flows and a gaseous fuel flow path (not shown) through which the gaseous fuel Fpg flows are formed in the pilot nozzle 21. Both the flow paths are opened at the tip portion 21*t* of the pilot nozzle 21 and the respective fuels Fpo and Fpg are injected from here.

The main nozzle 31 has a tubular nozzle rod 40, and a tubular oil fuel pipe 60 which is as a whole inserted into the nozzle rod 40. The nozzle rod 40 passes through the nozzle stand 71 of the nozzle mounting base 70. A rod tip portion 41*t* of the nozzle rod 40 protrudes into the turbine casing 4 and also a rod base end portion 41*b* of the nozzle rod 40 protrudes to the outside of the turbine casing 4. In the nozzle rod 40, a mounting portion 41*a* which is located in the nozzle mounting base 70 is fixed to the nozzle stand 71 of the nozzle mounting base 70 by welding. In addition, since the entire oil fuel pipe 60 is inserted into the nozzle rod 40, the rod tip portion 41*t* of the nozzle rod 40 forms the tip portion 31*t* of the main nozzle 31 and the rod base end portion 41*b* of the nozzle rod 40 forms the base end portion 31*b* of the main nozzle 31.

Figure 4:
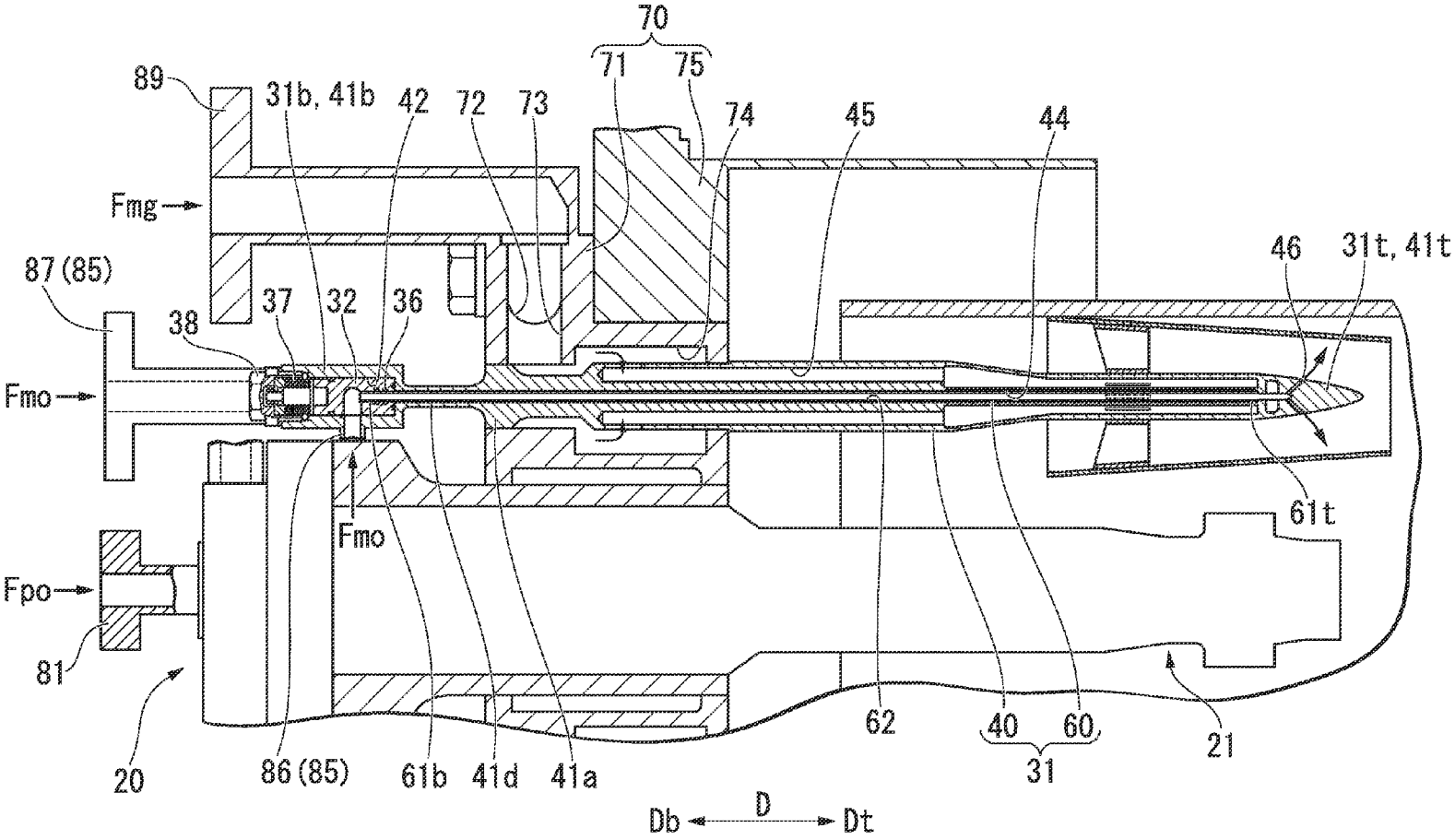
FIG. 4 is an overall cross-sectional view of a main nozzle according to an embodiment of the present invention.

An M-gaseous fuel receiving pipe 89 which receives gaseous fuel Fmg is connected to the outer periphery side of the nozzle stand 71, as shown in FIG. 4. In the inside of the nozzle stand 71, an annular fuel flow path 72 through which the gaseous fuel Fmg from the M-gaseous fuel receiving pipe 89 flows is formed at a position further on the outer periphery side than the plurality of main nozzles 31. In addition, a branched flow path 73 which branches toward each main nozzle 31 from the annular fuel flow path 72 and an in-stand fuel space 74 which leads the gaseous fuel Fmg from the branched flow path 73, to the surroundings of the mounting portion 41*a* of the nozzle rod 40, are formed in the nozzle stand 71.

In the rod base end portion 41*b* of the nozzle rod 40, when the rod base end portion 41*b* is viewed in a direction from the base end side Db to the tip side Dt, a base end portion inner space 42 having a cylindrical shape is formed. An M-oil fuel receiving pipe 85 which receives oil fuel Fmo and communicates with the base end portion inner space 42 is connected to the rod base end portion 41*b*. Further, a pipe insertion space 44 which extends from the base end portion inner space 42 to the rod tip portion 41*t* and in which the oil fuel pipe 60 is inserted is formed in the nozzle rod 40. In addition, in the nozzle rod 40, a gaseous fuel flow path 45 which extends from the mounting portion 41*a* of the nozzle rod 40 to the rod tip portion 41*t* of the nozzle rod 40 is formed at a position further on the outer periphery side than the pipe insertion space 44. The gaseous fuel flow path 45 is opened at the mounting portion 41*a* and communicates with the in-stand fuel space 74. Further, the gaseous fuel flow path 45 is opened at the rod tip portion 41*t* and this opening forms an injection port 46 for fuel.

A portion of the nozzle rod 40 between the rod base end portion 41*b* and the mounting portion 41*a* forms a cross-sectional area reduced portion 41*d* in which a cross-sectional area in a cross section perpendicular to the nozzle longitudinal direction D is smaller than the maximum cross-sectional area of the mounting portion 41*a*. In addition, the cross-sectional area of the cross-sectional area reduced portion 41*d* is smaller than the maximum cross-sectional area of the rod base end portion 41*b* in a cross section perpendicular to the nozzle longitudinal direction D.

A pipe tip portion 61*t* of the oil fuel pipe 60 is disposed in the pipe insertion space 44 of the nozzle rod 40 and fixed at the position of the rod tip portion 41*t* of the nozzle rod 40 by welding. Further, a pipe base end portion 61*b* of the oil fuel pipe 60 extends to the inside of the rod base end portion 41*b* of the nozzle rod 40. An oil fuel flow path 62 which passes through from the base end side Db of the oil fuel pipe 60 to the tip side Dt is formed in the oil fuel pipe 60. The oil fuel flow path 62 is opened at the pipe base end portion 61*b* and the pipe tip portion 61*t*. The oil fuel Fmo flows from an opening of the pipe base end portion 61*b* into the oil fuel flow path 62, flows out from an opening of the pipe tip portion 61*t*, and is injected from the injection port 46 of the nozzle rod 40 to the outside of the main nozzle 31.

Figure 5:
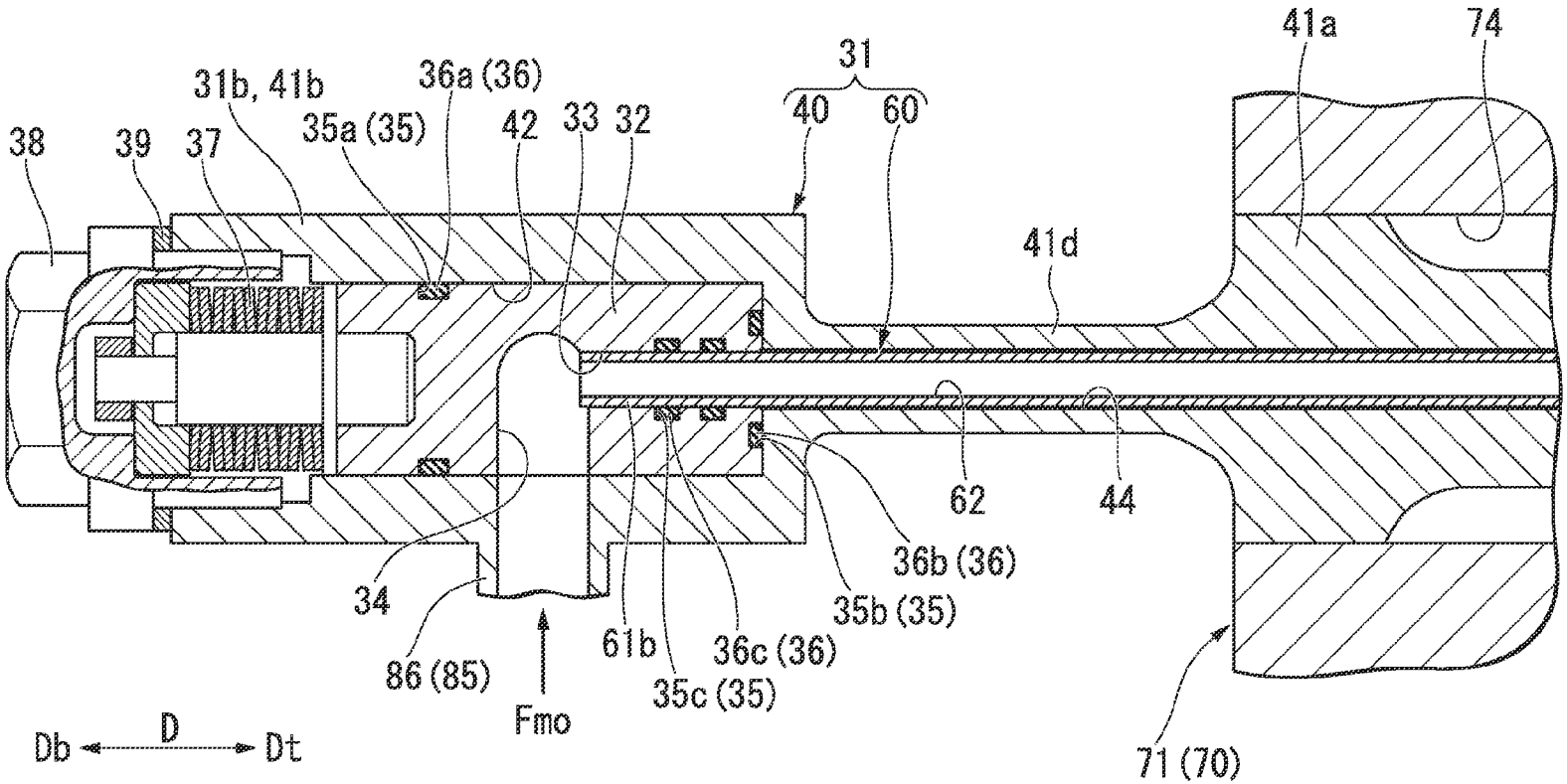
FIG. 5 is a cross-sectional view of a base end portion of the main nozzle according to an embodiment of the present invention.

The main nozzle 31 has, in addition to the nozzle rod 40 and the oil fuel pipe 60 described above, a columnar inner piece 32 which is accommodated in the columnar base end portion inner space 42 of the nozzle rod 40, a plurality of O-rings 36 as seal members, and an elastic body 37 such as a disk spring, as shown in FIG. 5. The main nozzle 31 further has a bolt 38 which presses the elastic body 37 while blocking an opening on the base end side Db of the rod base end portion 41*b* in the base end portion inner space 42, and a packing 39 which seals the gap between a bolt head portion of the bolt 38 and the rod base end portion 41*b* of the nozzle rod 40.

The inner piece 32 is accommodated in an area on the tip side Dt of the base end portion inner space 42 of the nozzle rod 40. In the inner piece 32, a pipe insertion space 33 in which the pipe base end portion 61*b* of the oil fuel pipe 60 is inserted, a communication path 34 which makes the oil fuel pipe 60 and the M-oil fuel receiving pipe 85 communicate with each other, and seal grooves 35, in each of which each of the O-rings 36 is mounted, are formed. The communication path 34 also plays a role as an orifice which controls the flow rate of the oil fuel Fmo from the M-oil fuel receiving pipe 85, thereby making the flow rate of the oil fuel Fmo which flows in the oil fuel pipe 60 to be a target flow rate.

As the seal grooves 35, there are a first seal groove 35*a* which is formed in the outer peripheral surface of the columnar inner piece 32, a second seal groove 35*b* which is formed in the end face on the tip side Dt of the inner piece 32, and a third seal groove 35*c* which faces the pipe insertion space 33. The each O-ring 36 is disposed in the seal groove 35. O-rings 36*a* and 36*b* which are disposed in the first seal groove 35*a* and the second seal groove 35*b* serve to seal the gap between the outer surface of the inner piece 32 and the inner surface of the rod base end portion 41*b*. Further, an O-ring 36*c* which is disposed in the third seal groove 35*c* serves to seal the gap between the inner surface of the inner piece 32 and the outer surface of the oil fuel pipe 60 while allowing thermal expansion and contraction of the oil fuel pipe 60 in the nozzle longitudinal direction D in the pipe insertion space 33 of the inner piece 32.

Further, the O-ring 36*a* disposed in the first seal groove 35*a* seals the gap between the outer surface of the inner piece 32 and the inner surface of the rod base end portion 41*b*, thereby suppressing leakage of the oil fuel Fmo from between these surfaces to the base end side Db. On the other hand, the O-ring 36*b* disposed in the second seal groove 35*b* and the O-ring 36*c* disposed in the third seal groove 35*c* seal the gap between the outer surface of the inner piece 32 and the inner surface of the rod base end portion 41*b* and the gap between the inner surface of the inner piece 32 and the outer surface of the oil fuel pipe 60, thereby suppressing leakage of the oil fuel Fmo from between these surfaces to the tip side Dt.

The elastic body 37 is disposed in the base end portion inner space 42 further on the base end side Db than the inner piece 32 with an elasticity direction thereof directed in the nozzle longitudinal direction D. The elastic body 37 is pressed to the tip side Dt by the bolt 38 which blocks an opening of the rod base end portion 41*b*, as described above. For this reason, the inner piece 32 is biased to the tip side Dt in the base end portion inner space 42 by the elastic body 37.

Figure 3:
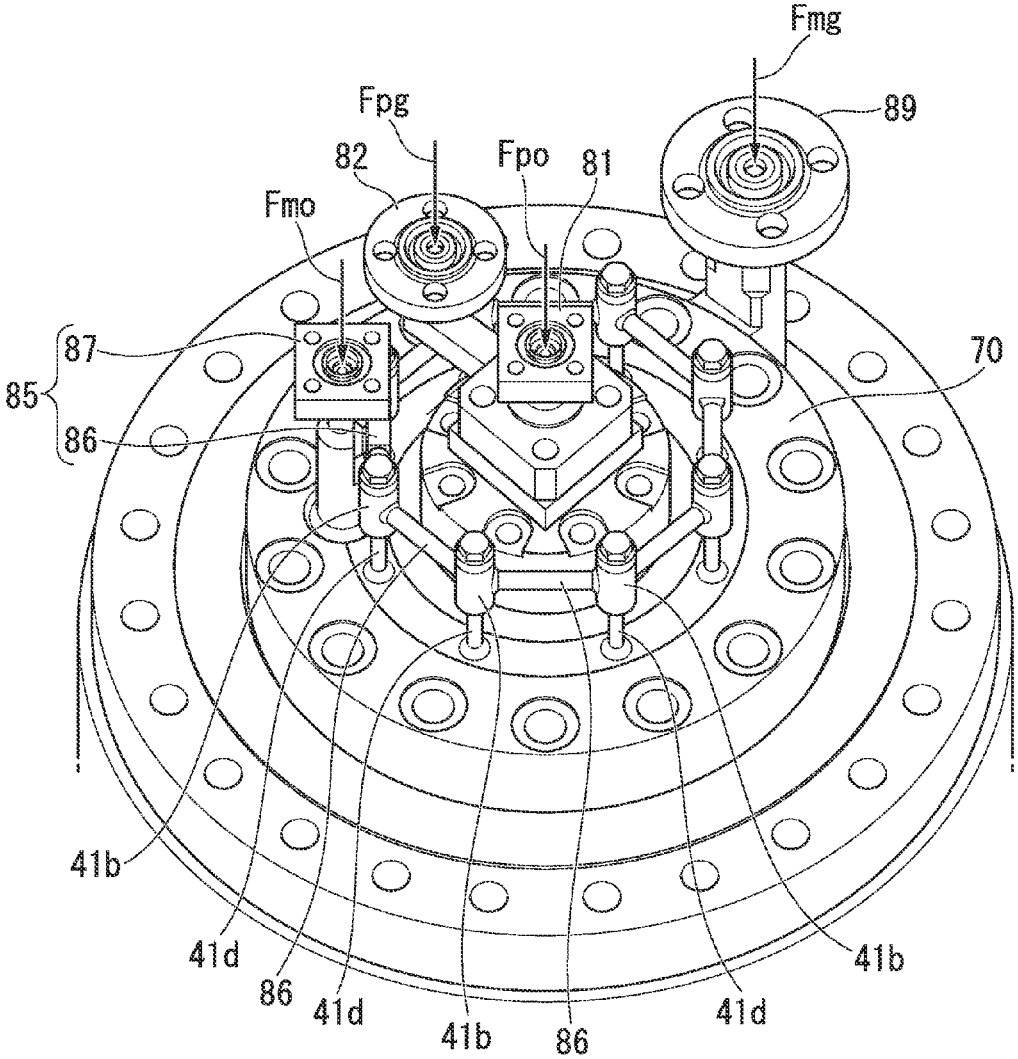
FIG. 3 is a perspective view of a main section of a combustor nozzle assembly according to an embodiment of the present invention.

The M-oil fuel receiving pipe 85 which is connected to the nozzle rod 40 has a plurality of connecting pipes 86 which connects the rod base end portions 41*b* of the nozzle rods 40 of the plurality of main nozzles 31 to each other, and a main receiving pipe 87 which supplies the oil fuel Fmo to one of the connecting pipes 86, as shown in FIG. 3. The plurality of main nozzles 31 are disposed at equal intervals in the circumferential direction with the pilot nozzle 21 as the center, as described above. For this reason, the plurality of connecting pipes 86 which connects the rod base end portions 41*b* of the nozzle rods 40 of the plurality of main nozzles 31 to each other are arranged in the circumferential direction with the pilot nozzle 21 as the center.

During an oil firing operation of the gas turbine according to this embodiment, the oil fuel Fmo is supplied from the outside through the M-oil fuel receiving pipe 85 to the plurality of main nozzles 31. The oil fuel Fmo flows in the base end portion inner space 42 of the nozzle rod 40 of the main nozzle 31. The oil fuel Fmo flows in the oil fuel flow path 62 of the oil fuel pipe 60 inserted into the pipe insertion space 33 of the inner piece 32, through the communication path 34 of the inner piece 32 disposed in the base end portion inner space 42, and is injected from the injection port 46 of the nozzle rod 40 to the outside of the main nozzle 31. The oil fuel Fmo injected to the outside of the main nozzle 31 is mixed and burned with the compressed air from the compressor 1. The high-temperature and high-pressure combustion gas generated by this burning is led to the blades of the turbine rotor 5 by the transition piece 10.

The oil fuel pipe 60 is cooled by the oil fuel flowing in the oil fuel pipe 60. On the other hand, since the nozzle rod 40 is exposed to the flow of the high-temperature and high-pressure compressed air from the compressor 1, the nozzle rod 40 is heated by this compressed air. For this reason, although the temperatures of the oil fuel pipe 60 and the nozzle rod 40 are uniform at the time of stopping of the gas turbine, during the oil firing operation, the temperature of the nozzle rod 40 becomes relatively high with respect to the temperature of the oil fuel pipe 60. Due to this temperature difference, a difference in thermal expansion between the oil fuel pipe 60 and the nozzle rod 40 occurs.

During a gas firing operation of the gas turbine according to this embodiment, the gaseous fuel Fmg is supplied to the plurality of main nozzles 31 through the M-gaseous fuel receiving pipe 89. The gaseous fuel Fmg flows from the M-gaseous fuel receiving pipe 89 into the annular fuel flow path 72 in the nozzle stand 71 and flows from there through the branched flow path 73 and the in-stand fuel space 74 in the nozzle stand 71 into the gaseous fuel flow path 45 in the nozzle rod 40.

The gaseous fuel Fmg is injected from the injection port 46 of the nozzle rod 40 to the outside of the main nozzle 31.

The gaseous fuel Fmg injected to the outside of the main nozzle 31 is mixed and burned with the compressed air from the compressor 1, similar to the time of the oil firing operation. The high-temperature and high-pressure combustion gas generated by this burning is led to the blades of the turbine rotor 5 by the transition piece 10.

During this gas firing operation, since the oil fuel Fmo is not supplied to the oil fuel pipe 60, the oil fuel pipe 60 is not cooled by the oil fuel Fmo. For this reason, the oil fuel pipe 60 has a temperature close to the temperature of the nozzle rod 40 and becomes hotter than when the oil fuel is burned. However, the temperature of the oil fuel pipe 60 does not rise as much as the temperature of the nozzle rod 40 directly exposed to the flow of the compressed air. Accordingly, even during the gas firing operation and the oil firing operation, a difference in temperatures between the oil fuel pipe 60 and the nozzle rod 40 occurs, and due to this, a difference in thermal expansion between the oil fuel pipe 60 and the nozzle rod 40 occurs.

Incidentally, the pipe tip portion 61*t* of the oil fuel pipe 60 is fixed to the rod tip portion 41*t* of the nozzle rod 40 by welding, as described above. For this reason, if the length of the oil fuel pipe 60 relatively changes with respect to the length of the nozzle rod 40, the relative position of the pipe base end portion 61*b* of the oil fuel pipe 60 changes with respect to the position of the rod base end portion 41*b* of the nozzle rod 40. Specifically, since, for example, compared to the time of stopping of the gas turbine, the temperature of the oil fuel pipe 60 during the oil firing operation is relatively lowered with respect to the temperature of the nozzle rod 40, the length of the oil fuel pipe 60 with respect to the length of the nozzle rod 40 becomes relatively short. Accordingly, during the oil firing operation, compared to the time of stopping of the gas turbine, the position of the pipe base end portion 61*b* of the oil fuel pipe 60 moves to the tip side Dt with respect to the position of the rod base end portion 41*b* of the nozzle rod 40.

In this manner, according to an operating condition of the gas turbine, in the nozzle longitudinal direction D, the position of the pipe base end portion 61*b* of the oil fuel pipe 60 relatively moves with respect to the position of the rod base end portion 41*b* of the nozzle rod 40. For this reason, the O-ring 36*c* which is disposed in the third seal groove 35*c* of the inner piece 32 disposed in the rod base end portion 41*b* of the nozzle rod 40 allows thermal expansion and contraction of the oil fuel pipe 60 in the nozzle longitudinal direction D in the pipe insertion space 33 of the inner piece 32 even while sealing the gap between the inner surface of the inner piece 32 and the outer surface of the oil fuel pipe 60.

Further, the inner piece 32 in the rod base end portion 41*b* of the nozzle rod 40 tends to move in the same direction as the moving direction of the pipe base end portion 61*b* due to the movement of the pipe base end portion 61*b* of the oil fuel pipe 60. In addition, a difference in thermal expansion also occurs between the rod base end portion 41*b* of the nozzle rod 40 and the inner piece 32. Due to this difference in thermal expansion, the inner piece 32 tends to move in the rod base end portion 41*b* of the nozzle rod 40. For this reason, the O-rings 36*a* and 36*b* which are disposed in the first and second seal grooves 35*a* and 35*b* of the inner piece 32 disposed in the rod base end portion 41*b* of the nozzle rod 40 allows movement in the nozzle longitudinal direction D of the inner piece 32 in the rod base end portion 41*b* of the nozzle rod 40 even while sealing the gap between the outer surface of the inner piece 32 and the inner surface of the rod base end portion 41*b*.

Incidentally, the rod base end portion 41*b* of the nozzle rod 40 is provided to protrude to the outside of the turbine casing 4. For this reason, it is difficult for the rod base end portion 41*b* of the nozzle rod 40 to receive heat from the nozzle mounting base 70. Further, in the cross-sectional area reduced portion 41*d* of the nozzle rod 40, as described above, the cross-sectional area in a cross section perpendicular to the nozzle longitudinal direction D is smaller than the maximum cross-sectional area in the mounting portion 41*a* of the nozzle rod 40. For this reason, the cross-sectional area reduced portion 41*d* of the nozzle rod 40 increases thermal resistance in a heat transfer pathway from the turbine casing 4 to the rod base end portion 41*b*. In addition, since the rod base end portion 41*b* of the nozzle rod 40 is exposed to the outside of the combustor 2, a cooling effect by heat exchange with the outside can also be expected. Accordingly, in this embodiment, an increase in the temperature of the rod base end portion 41*b* of the nozzle rod 40 according to combustion of the fuel and an increase in the temperature of the O-ring 36 according to the increase in the temperature of the rod base end portion 41*b* can be suppressed.

Therefore, according to this embodiment, damage to the O-ring 36 due to heat can be suppressed, and thus the life of the O-ring 36 can be extended.

Further, in this embodiment, even if the O-rings 36*b* and 36*c* which prevent leakage of the oil fuel Fmo to the tip side Dt are damaged, leakage of the oil fuel Fmo to the outside can be prevented. This is because the oil fuel Fmo which has flowed in the base end portion inner space 42 of the nozzle rod 40 flows in a heat insulating space between the inner surface of the nozzle rod 40 and the outer surface of the oil fuel pipe 60 through the gap between the inner surface of the inner piece 32 and the outer surface of the oil fuel pipe 60 sealed by the O-ring 36*c* or the gap between the outer surface of the inner piece 32 and the inner surface of the rod base end portion 41*b* of the nozzle rod 40 sealed by the O-ring 36*b*. That is, in this embodiment, the heat insulating space plays a role as a leaked oil recovery space at the time of damage to the O-rings 36*b* and 36*c*.

Further, in this embodiment, even if the O-ring 36*a* which prevents leakage of the oil fuel Fmo to the base end side Db is damaged, since the packing 39 exists further to the base end side Db than the O-ring 36*a*, leakage of the oil fuel Fmo to the outside can be prevented. Here, since the packing 39 is for sealing the gap between the bolt head portion of the bolt 38 and the rod base end portion 41*b* of the nozzle rod 40 which make little relative movement due to a change in temperature, the life of the packing 39 is longer than that of the O-ring 36*a*. For this reason, leakage of the oil fuel Fmo to the outside due to damage to the packing 39 need not be considered as much as damage to the O-ring 36.

Therefore, in this embodiment, since an oil manifold having a complicated shape, in which a leaked oil recovery chamber is formed, and a support thereof become unnecessary, the manufacturing cost can be reduced.

Next, various modified examples of the nozzle rod will be described using FIGS. 6 to 9.

Figure 6:
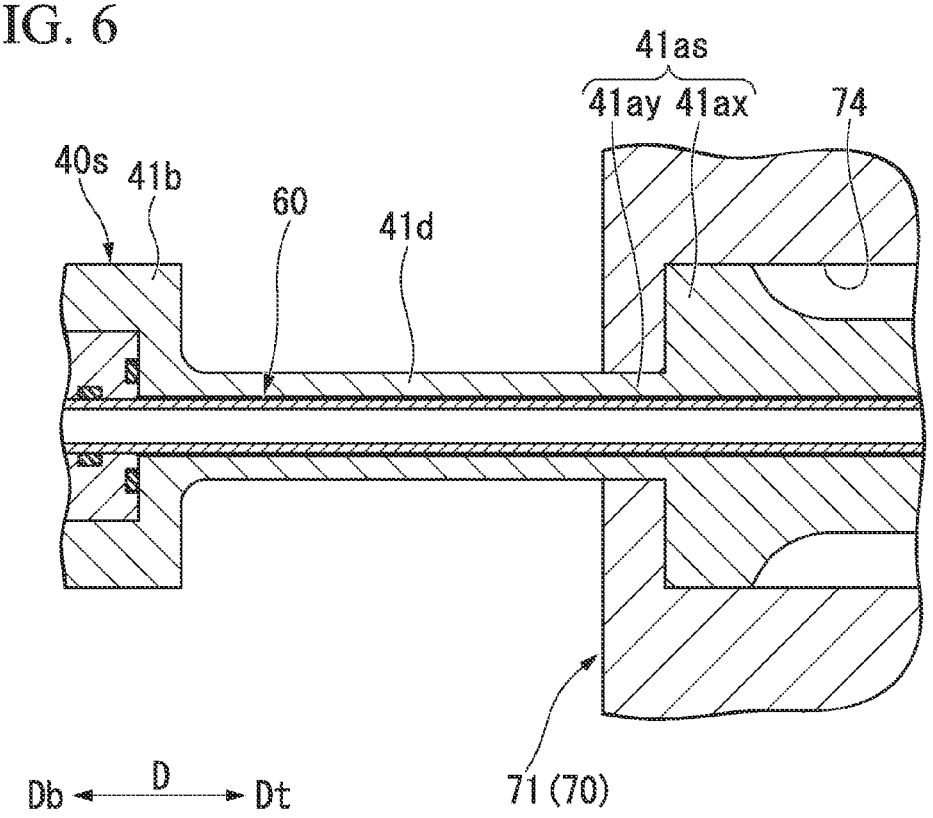
FIG. 6 is a cross-sectional view of a main section of a nozzle rod in a first modified example according to an embodiment of the present invention.

First, a first modified example of the nozzle rod will be described using FIG. 6.

The shape of a nozzle rod 40*s* according to this modified example is slightly different from the shape of the nozzle rod 40 in the above-described embodiment.

In the nozzle rod 40*s* according to this modified example, a mounting portion 41*as* which is located in the nozzle mounting base 70 has a main mounting portion 41*ax* in which a cross-sectional area in a cross section perpendicular to the nozzle longitudinal direction D is the largest, and a reduced diameter portion 41*ay*. The reduced diameter portion 41*ay* is formed on the base end side Db of the main mounting portion 41*ax* and the cross-sectional area of the reduced diameter portion 41*ay* is the same as the cross-sectional area of the cross-sectional area reduced portion 41*d* of the nozzle rod 40*s*.

In this manner, even if the mounting portion 41*as* of the nozzle rod 40*s* has the reduced diameter portion 41*ay*, if the cross-sectional area in a cross section perpendicular to the nozzle longitudinal direction D of the cross-sectional area reduced portion 41*d* is smaller than the maximum cross-sectional area of the mounting portion 41*as*, thermal resistance in the heat transfer pathway from the turbine casing 4 to the rod base end portion 41*b* can be increased, similar to the above-described embodiment.

Figure 7:
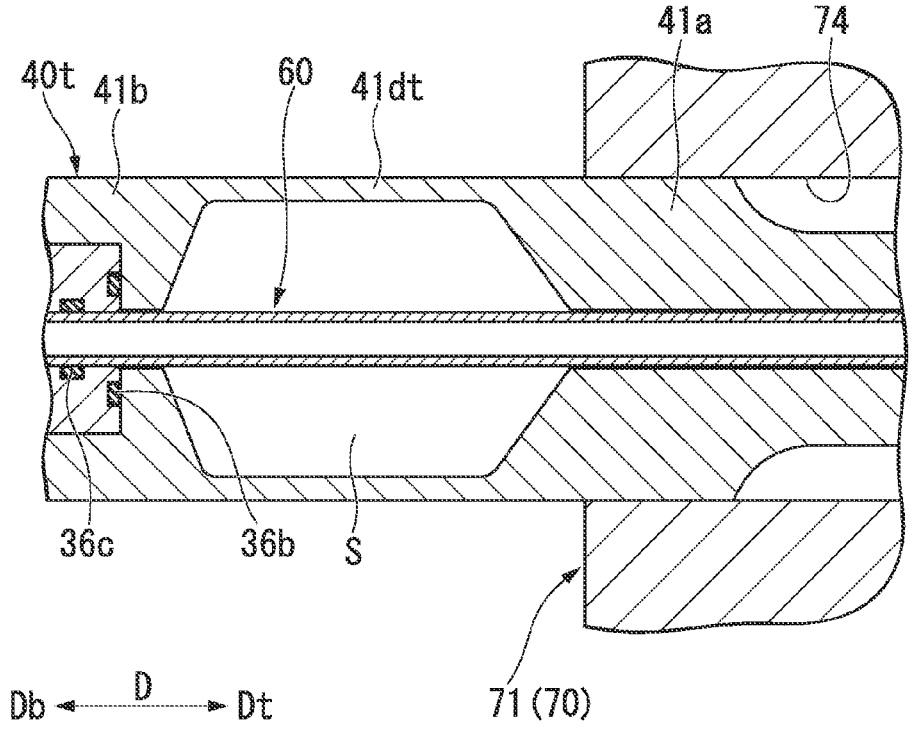
FIG. 7 is a cross-sectional view of a main section of a nozzle rod in a second modified example according to an embodiment of the present invention.

Next, a second modified example of the nozzle rod will be described using FIG. 7.

The shape of a nozzle rod 40*t* according to this modified example is also slightly different from the shape of the nozzle rod 40 in the above-described embodiment.

The outer diameter of a cross-sectional area reduced portion 41*dt* in the nozzle rod 40*t* according to this modified example is the same as the outer diameter of the mounting portion 41*a* and the inner diameter of the cross-sectional area reduced portion 41*dt* is larger than the inner diameter of the mounting portion 41*a*. For this reason, in the cross-sectional area reduced portion 41*dt*, the outer diameter of the cross-sectional area reduced portion 41*dt* becomes larger than the outer diameter of the cross-sectional area reduced portion 41*d* in the above-described embodiment. However, the cross-sectional area in a cross section perpendicular to the nozzle longitudinal direction D becomes smaller than the maximum cross-sectional area of the mounting portion 41*a* of the nozzle rod 40*t*, similar to the above-described embodiment. For this reason, also in this modified example, similar to the above-described embodiment, thermal resistance in the heat transfer pathway from the turbine casing 4 to the rod base end portion 41*b* can be increased.

Figure 8:
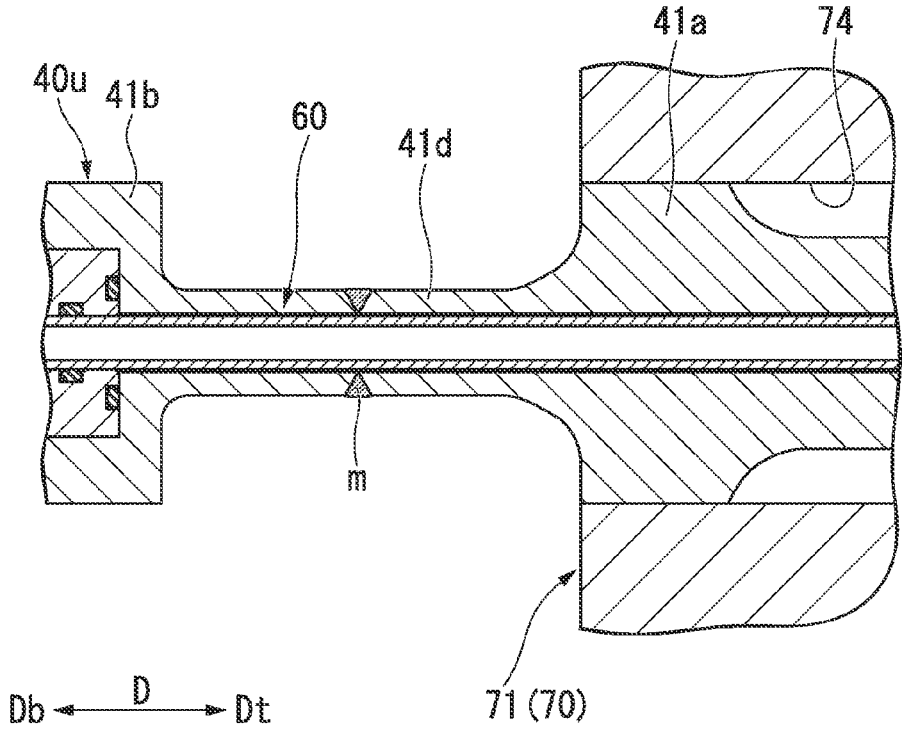
FIG. 8 is a cross-sectional view of a main section of a nozzle rod in a third modified example according to an embodiment of the present invention.
Figure 9:
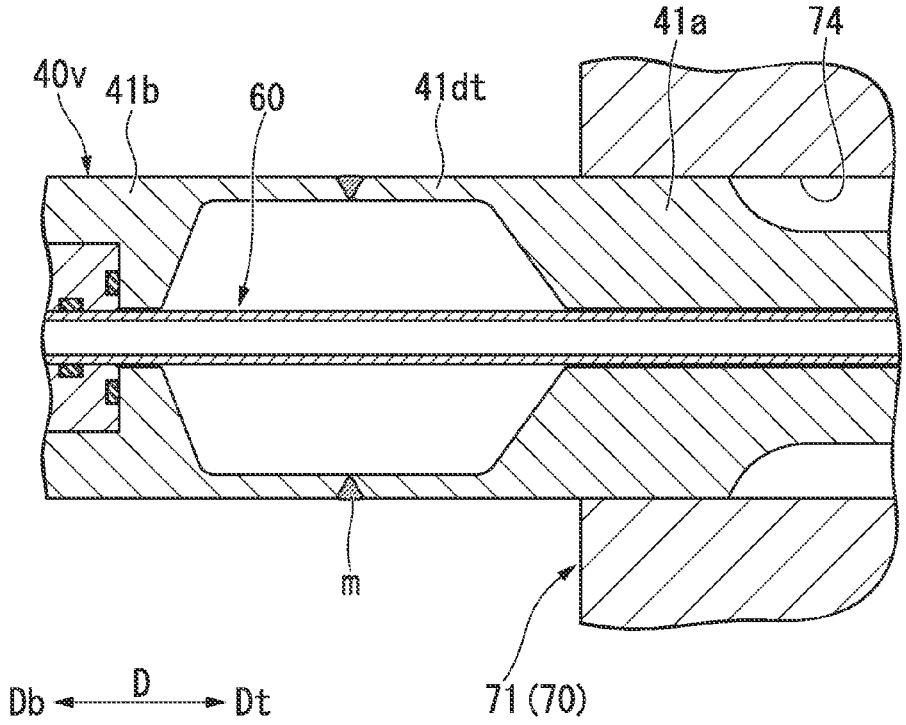
FIG. 9 is a cross-sectional view of a main section of a nozzle rod in a fourth modified example according to an embodiment of the present invention.

Next, a third modified example of the nozzle rod will be described using FIG. 8, and a fourth modified example of the nozzle rod will be described using FIG. 9.

A nozzle rod 40*u* according to the third modified example has the same shape as the nozzle rod 40 in the above-described embodiment. However, the nozzle rod 40*u* according to this modified example is formed by joining a member on the tip side Dt of the nozzle rod 40*u* and a member on the base end side Db of the nozzle rod 40*u* to each other by welding. Further, a nozzle rod 40*v* according to the fourth modified example has the same shape as the nozzle rod 40*t* according to the second modified example. However, the nozzle rod 40*v* according to this modified example is also formed by joining a member on the tip side Dt of the nozzle rod 40*v* and a member on the base end side Db of the nozzle rod 40*v* to each other by welding, similar to the third modified example. For this reason, in the nozzle rods 40*u* and 40*v* according to these modified examples, welded portions m exists in, for example, the cross-sectional area reduced portions 41*d* and 41*dt*.

As in the nozzle rods 40*v* and 40*u* according to the third and fourth modified examples described above, even if the nozzle rod is formed by joining a member on the tip side Dt of the nozzle rod and a member on the base end side Db of the nozzle rod to each other by welding, basically the same effect as the nozzle rod 40 in the above-described embodiment or the nozzle rod 40*t* in the second modified example can be obtained. Further, in the nozzle rods 40*v* and 40*u* according to the third and fourth modified examples, if the welded portions m exist in the cross-sectional area reduced portions 41*d* and 41*dt*, thermal resistance in the heat transfer pathway from the turbine casing 4 to the rod base end portion 41*b* can be further increased.

In addition, here, each of the nozzle rods 40*v* and 40*u* having the same shape as the nozzle rod 40 in the above-described embodiment or the nozzle rod 40*t* in the second modified example is formed by joining of two members by welding. However, a nozzle rod having the same shape as the nozzle rod 40*s* according to the first modified example may also be formed by joining of two members by welding. In addition, here, the nozzle rod is formed by joining two members by welding. However, an oil fuel pipe having the same shape as the oil fuel pipe 60 in the above-described embodiment may also be formed by joining two members by welding.

Further, in the above-described embodiment, for flow rate regulation or the like, the inner piece 32 is disposed in the base end portion inner space 42 of the nozzle rod 40. However, the inner piece 32 may be omitted. In this case, a function to regulate the flow rate of the oil fuel Fmo is given to a portion which receives the oil fuel Fmo from the M-oil fuel receiving pipe 85, in the base end portion inner space 42.

In addition, the main nozzle 31 in the above-described embodiment is a so-called dual nozzle which injects both fuel oil and fuel gas. However, the invention is not limited thereto, and if a nozzle has a nozzle rod and an oil fuel pipe, a nozzle which does not inject fuel gas is also acceptable.

INDUSTRIAL APPLICABILITY

According to the combustor nozzle assembly, even if an oil manifold having a complicated shape, in which a leaked oil recovery chamber is formed, is not provided, it is possible to prevent leakage of fuel. Further, since it is also not necessary to provide a support, the manufacturing cost can be reduced.

REFERENCE SIGNS LIST

1: compressor
2: combustor
3: turbine
4: turbine casing
4*a*: combustor insertion opening
5: turbine rotor
10: transition piece
20: nozzle assembly
21: pilot nozzle
31: main nozzle
32: inner piece
33: pipe insertion space
36: O-ring (seal member)
37: elastic body
38: bolt
39: packing
40, 40*s*, 40*t*, 40*u*, 40*v*: nozzle rod
41*b*: rod base end portion
41*d*, 41*dt*: cross-sectional area reduced portion
41*a*: mounting portion
41*t*: rod tip portion
42: base end portion inner space
44: pipe insertion space
45: gaseous fuel flow path
46: injection port
60: oil fuel pipe
61*b*: pipe base end portion
61*t*: pipe tip portion

62: oil fuel flow path
70: nozzle mounting base
71: nozzle stand
75: nozzle stand frame

The invention claimed is:

1. A combustor nozzle assembly of a gas turbine comprising:

a nozzle mounting base that blocks a combustor insertion opening formed in a turbine casing;

a nozzle rod formed in a tubular shape, passes through the nozzle mounting base, and having a rod tip portion protruding to an inside of the turbine casing and a rod base end portion protruding to the outside of the turbine casing;

a fuel pipe formed in a tubular shape, inserted as a whole into the nozzle rod, having a pipe tip portion fixed to the rod tip portion of the nozzle rod and a pipe base end portion inserted into the rod base end portion of the nozzle rod, wherein fuel is supplied to an inside of the fuel pipe through the rod base end portion, and injects the fuel from the pipe tip portion through the rod tip portion of the nozzle rod; and a seal member disposed in the rod base end portion of the nozzle rod and suppresses leakage of the fuel to a pipe tip portion side between an inner periphery side of the nozzle rod and an outer periphery side of the fuel pipe, wherein the nozzle rod comprises:

a mounting portion located in the nozzle mounting base; and a cross-sectional area reduced portion provided between the mounting portion and the rod base end portion, wherein a cross-sectional area of the cross-sectional area reduced portion perpendicular to a direction that the nozzle rod extends is smaller than a maximum cross-sectional area of the mounting portion, and is also smaller than a cross-sectional area of the rod base end portion.

2. The combustor nozzle assembly of a gas turbine according to claim 1, wherein the cross-sectional area reduced portion of the nozzle rod is exposed to the outside of a combustor.

3. The combustor nozzle assembly of a gas turbine according to claim 1, wherein the rod base end portion of the nozzle rod is exposed to the outside of a combustor.

4. The combustor nozzle assembly of a gas turbine according to claim 1, further comprising:

a fuel receiving pipe connected to the rod base end portion of the nozzle rod and supplies the fuel into the fuel pipe through the rod base end portion.

5. A combustor of a gas turbine comprising:

the combustor nozzle assembly of a gas turbine according to claim 1; and a transition piece that leads combustion gas generated by burning of fuel injected from the pipe tip portion of the nozzle rod of the combustor nozzle assembly, to a turbine.

6. A gas turbine comprising:

the combustor according to claim 5;

a turbine rotor that is rotated by the combustion gas from the combustor; and the turbine casing that covers the turbine rotor and wherein the combustor is mounted to the turbine casing.

* * * * *